US006327990B1

(12) United States Patent
Crifase et al.

(10) Patent No.: US 6,327,990 B1
(45) Date of Patent: Dec. 11, 2001

(54) BOAT LANDING APPARATUS

(76) Inventors: Philip A. Crifase; Joy P. Crifase, both of 7623 Sussex Creek Dr., #303, Darien, IL (US) 60561

( * ) Notice: Subject to any disclaimer, the term of this patent is extended or adjusted under 35 U.S.C. 154(b) by 0 days.

(21) Appl. No.: 09/873,473

(22) Filed: Jun. 4, 2001

Related U.S. Application Data

(63) Continuation-in-part of application No. 09/691,757, filed on Oct. 18, 2000, now Pat. No. 6,263,820.

(51) Int. Cl.[7] ..... B63B 59/02
(52) U.S. Cl. ..... 114/219; 405/1
(58) Field of Search ..... 405/1–7; 114/219, 114/44–48, 230.1

(56) References Cited

U.S. PATENT DOCUMENTS 2,658,354 11/1953 Lee ..... 61/67
5,449,247 9/1995 Smith ..... 405/3
5,460,112 10/1995 Travioli ..... 114/230
5,888,019 * 3/1999 Quastad ..... 405/3
5,908,264 * 6/1999 Hey ..... 405/3

* cited by examiner

*Primary Examiner*—Ed Swinehart
(74) *Attorney, Agent, or Firm*—Donald J. Ersler

(57) ABSTRACT

A boat landing apparatus includes a pair of roller assemblies, at least two cross members, at least four support brackets, at least four support posts, and at least four support spacers. Each roller assembly includes a plurality of rollers pivotally retained in a roller frame. One end of each roller assembly is mounted to one of the cross members and the other end of each roller assembly is mounted to the other cross member. A wedge spacer may be inserted between a bottom of the roller frame and a top of the cross member bracket. The wedge spacer enables the roller assembly to have an inward tilt. A single support bracket is secured to each end of each cross member. A single support post is secured to a bottom of each support bracket. A single support spacer is attached to each support post.

17 Claims, 9 Drawing Sheets

BOAT LANDING APPARATUS

CROSS-REFERENCES TO RELATED APPLICATIONS

This is a continuation-in-part application of Ser. No. 09/691,757 filed on Oct. 18, 2000, now U.S. Pat. No. 6,263,820.

BACKGROUND OF THE INVENTION

1. Field of the Invention

The present invention relates generally to landing a boat on shore and more specifically to a boat landing apparatus which may be used to easily land and retain a boat without removing thereof from the water.

2. Discussion of the Prior Art

There are numerous boating landing devices such as U.S. Pat. No. 2,658,354 to Lee, U.S. Pat. No. 5,449,247 to Smith, and U.S. Pat. No. 5,460,112 to Travioli. All three of the these patents have the same drawback. Only a small length of the boat is guided when the boat is in contact with the boat landing device. A boat landing device which only contacts a small length of the boat lacks stability. Another problem occurs to a small boat when it rains. If it rains hard enough, the small boat anchored at a pier will fill with rain water and sink. The alternative is to pull the boat on to the shore. However, this is an inconvenient and time consuming process.

Accordingly, there is a clearly felt need in the art for a boat landing apparatus which provides greater stability when landing a boat than that of the prior art and easily stores a small boat in a secure position for drainage of rain water.

SUMMARY OF THE INVENTION

The present invention provides a boat landing apparatus which is easier to use than that of the prior art. The boat landing apparatus includes a pair of roller assemblies, a pair of cross members, four cross member brackets, and at least two retention stakes. Each roller assembly includes a plurality of rollers pivotally retained in a roller frame. Each cross member bracket is mounted to substantially each end of each roller assembly. A wedge spacer may be mounted to a bottom of the roller frame before attachment of the cross member bracket. The wedge spacer enables the roller assembly to have an inward tilt. An opening is formed through substantially a center of the bracket and the roller frame. Each cross member bracket is sized to slidably receive the perimeter of the cross member. Each cross member has a plurality of openings formed along a length thereof. The width of the boat landing apparatus may be adjusted by aligning the opening in the roller frame with one of the openings in the cross member. A single stake is then inserted through the openings in the roller assembly and cross member into the mounting surface.

A height spacer may be used to tilt the boat landing device. The height spacer allows the boat landing apparatus to be tilted for raising or lowering either end of the boat. The rear of the boat may be tilted downward to drain water therefrom, if necessary. The height spacer preferably includes a post retainer, a tubular post, and a flange retainer. A single post retainer is attached to a bottom of each end of each roller assembly. The tubular post is retained by the post retainer. The flange retainer is clamped to the tubular post to prevent thereof from sinking into the lake bottom.

A second embodiment of the boat landing apparatus includes a pair of roller assemblies, at least two cross members, at least four support brackets, at least four support posts, and at least four support spacers. Each roller assembly includes a plurality of rollers pivotally retained in a roller frame. One end of each roller assembly is mounted to one of the cross members and the other end of each roller assembly is mounted to the other cross member. Additional cross members may be used to support extra weight. A wedge spacer may be inserted between a bottom of the roller frame and a top of the cross member. The wedge spacer enables the roller assemblies to have an inward tilt. A single support bracket is secured to each end of each cross member. A single support post is secured to a bottom of each support bracket. A single support spacer is attached to each support post.

The second embodiment of the boat landing apparatus is preferably installed as follows. The support posts are located and then inserted into a bottom of the body of water. A single support spacer is then slid on to each support post. The support spacers are then pushed against the bottom of the body of water and secured to the support posts. A single support bracket is attached to a top of each support post. Each cross member is slid through a pair of support brackets and secured thereto. The pair of roller assemblies are then attached to the cross members. A single guide post may be attached to a top of each support bracket. A boat may be tied to at least one guide post. Providing at least two cross members with a sufficient length will allow an access plank to mounted thereto. The second embodiment of the boat landing apparatus may also be assembled and then placed on a bottom of a body of water.

Accordingly, it is an object of the present invention to provide a boat landing apparatus which provides greater stability when landing a boat than that of the prior art.

It is a further object of the present invention to provide a boat landing apparatus which may be tilted to adjust to a sloped lake bottom.

It is yet a further object of the present invention to provide a boat landing apparatus which allows a boat to be accessed from a side thereof.

It is yet a further object of the present invention to provide a boat landing apparatus which may be pitched to allow a small boat to be drained of rain water.

It is yet a further object of the present invention to provide a boat landing apparatus which allows a boat to be held in a secure position.

Finally, it is another object of the present invention to provide a boat landing apparatus which has an adjustable width to accommodate different size boats.

These and additional objects, advantages, features and benefits of the present invention will become apparent from the following specification.

DETAILED DESCRIPTION OF THE PREFERRED EMBODIMENTS

Figure 1:
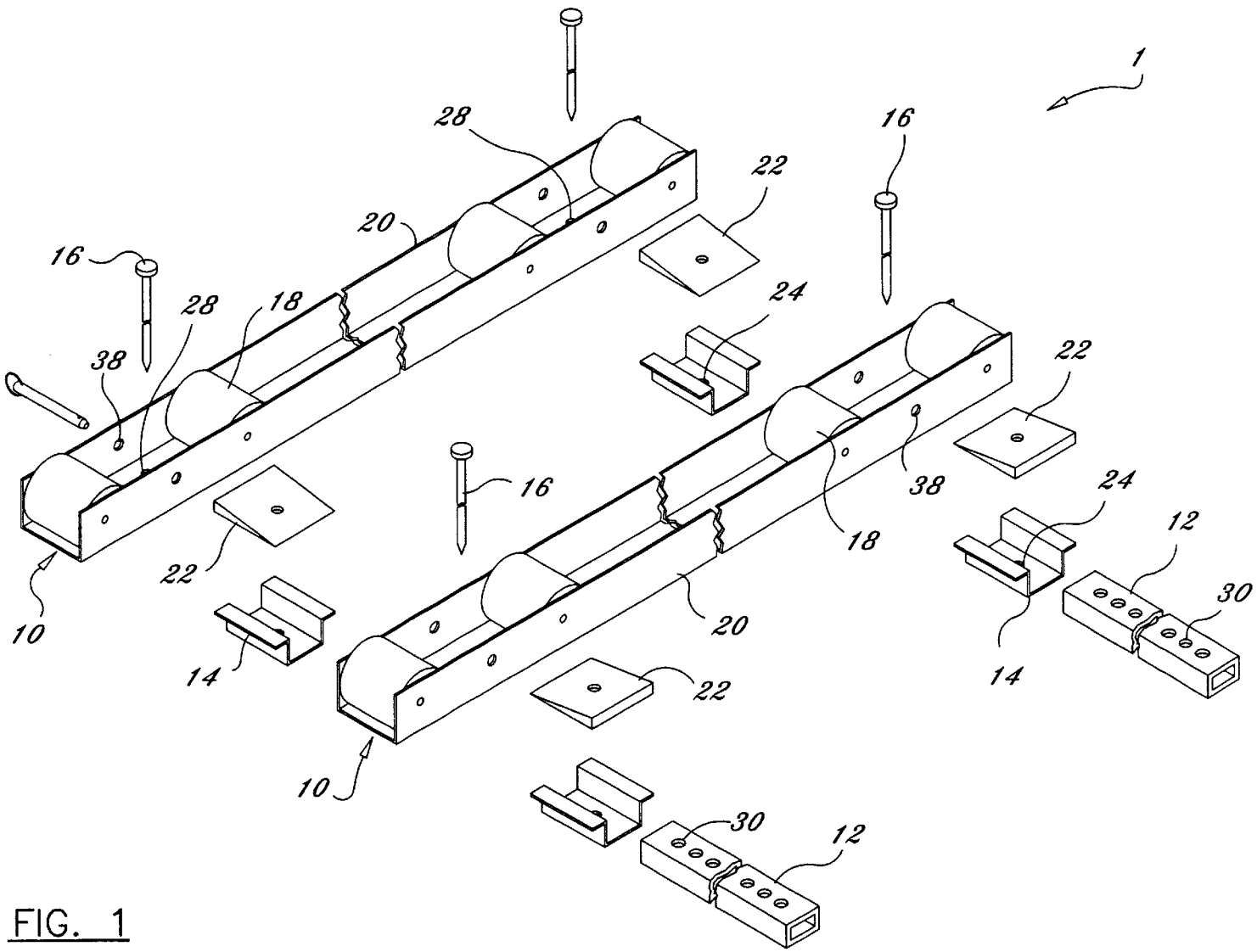
FIG. 1 is an exploded perspective view of a boat landing apparatus in accordance with the present invention.
Figure 2:
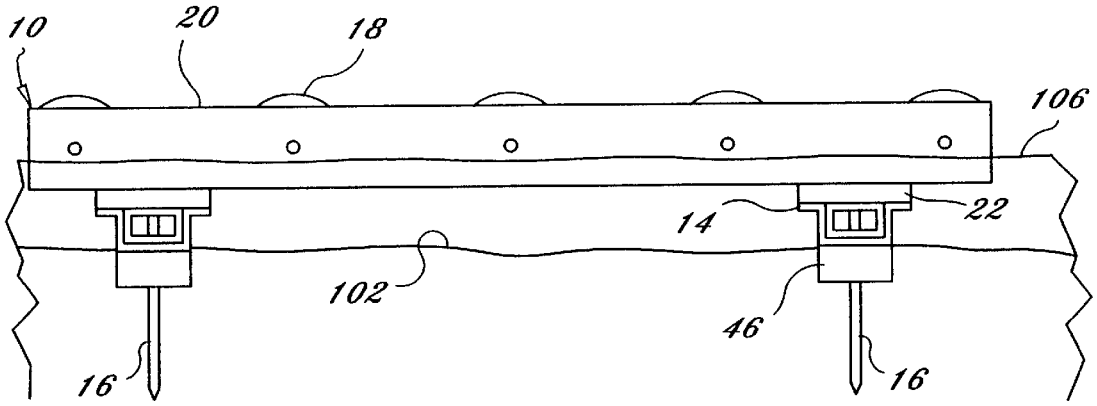
FIG. 2 is a side view of a boat landing apparatus in accordance with the present invention.
Figure 3:
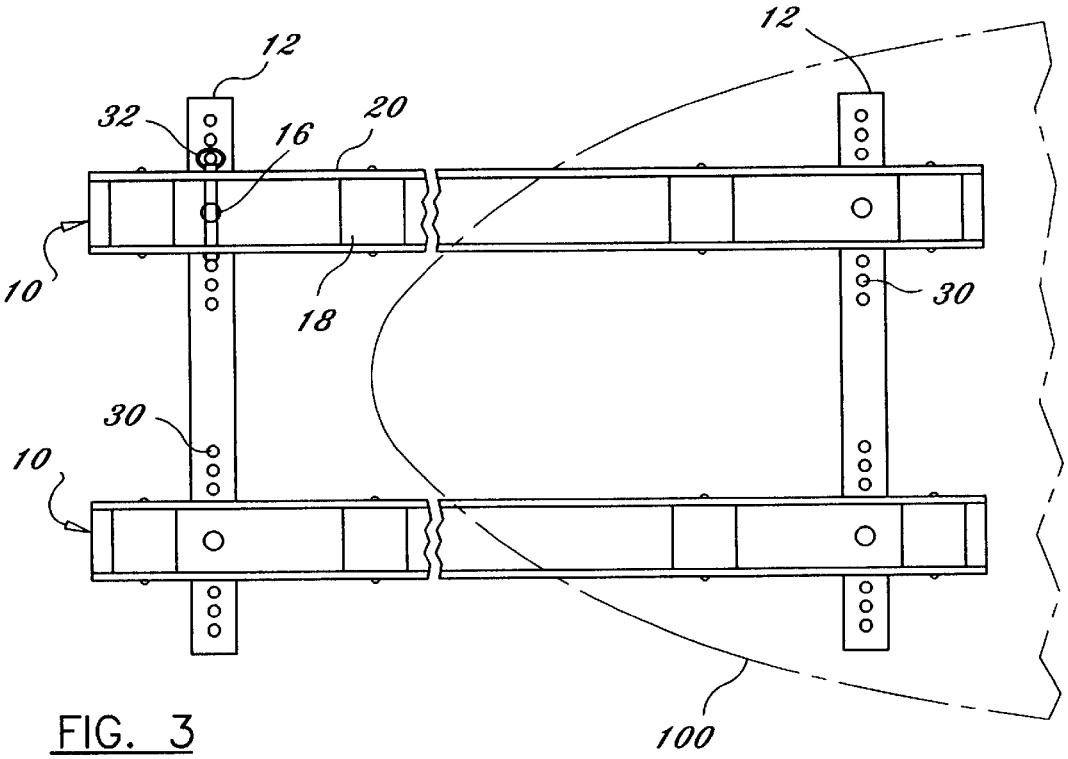
FIG. 3 is a top view of a boat landing apparatus in accordance with the present invention.
Figure 4:
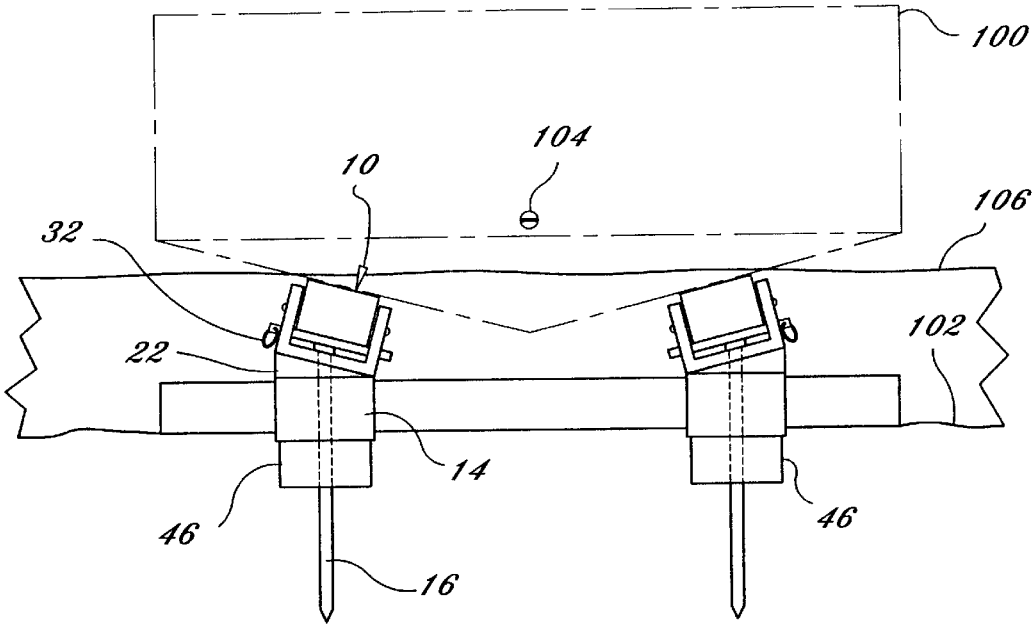
FIG. 4 is a rear view of a boat landing apparatus in accordance with the present invention.

With reference now to the drawings, and particularly to FIG. 1, there is shown an exploded perspective view of a boat landing apparatus 1. With reference to FIGS. 2 and 3, the boat landing apparatus 1 includes a pair of roller assemblies 10, a pair of cross members 12, four cross member brackets 14, and at least two retention stakes 16. Each roller assembly 10 includes a plurality of rollers 18 pivotally retained in a roller frame 20. The roller assembly 10 is preferably purchased from Marine & Trailer Products. One particular design of roller assembly 10 is shown, but other designs of roller assemblies may also be used. A single cross member bracket 14 is mounted to substantially each end of each roller frame 20. The cross member bracket 14 is preferably fabricated from an aluminum sheet stock. Other suitable materials may also be used. A wedge spacer 22 may be mounted to a bottom of the roller frame 20 before attachment of the cross member bracket 14. The wedge spacer 22 enables the roller assembly 10 to have an inward tilt to guide a front of a boat 100 into the boat landing apparatus 1 as shown in FIG. 3. If no tilt is required, then the wedge spacer 22 is not included with the boat landing apparatus 1. The wedge spacer 22 may be fabricated from any material which does not corrode in water.

The cross member bracket 14 and/or the wedge spacer 22 may be attached to a bottom of the roller frame 20 with welding, fasteners, adhesive, or any other suitable assembly process. The cross member bracket 14 may be attached to a bottom of the wedge spacer 22 with welding, fasteners, adhesive, or any other suitable assembly process. An opening 24 is formed through substantially a center of the cross member bracket 14, an opening 26 is formed through the wedge spacer 22, and an opening 28 is formed through substantially each end of the roller frame 20. Each cross member bracket 14 is sized to slidably receive the perimeter of the cross member 12.

Each cross member 12 has a plurality of openings 30 formed along a length thereof. The width of the boat landing apparatus 1 may be adjusted by aligning the opening 28 in the roller frame 20 with one of the openings 30 in the cross member 12. The cross member 12 is preferably fabricated from an rectangular cross section of aluminum tube. Other suitable materials may also be used. A single stake 16 is then inserted through the openings into the mounting surface 102. Each stake 16 preferably has a horizontally serrated surface to enhance retention by the mounting surface 102 such as sand on a lake floor. The stake 16 is preferably fabricated from an aluminum rod. Other suitable materials may also be used. A single post retainer 46 is preferably attached to each end of each roller assembly 10 at a bottom thereof with any suitable assembly process such as welding.

Figure 5:
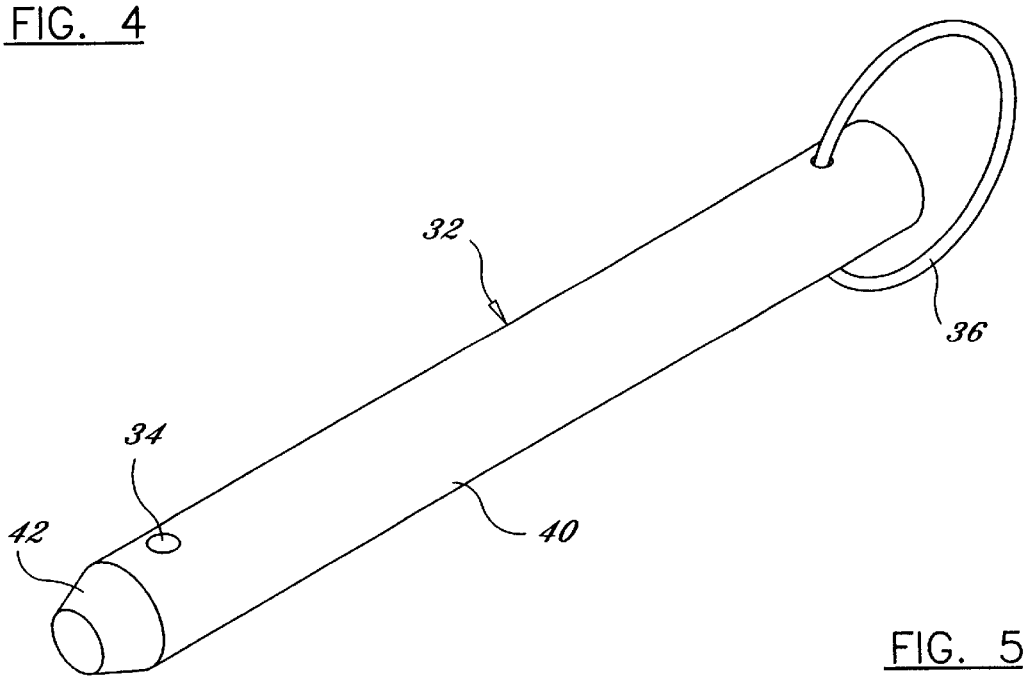
FIG. 5 is a perspective view of a stake retention pin of a boat landing apparatus in accordance with the present invention.

With reference to FIG. 5, preferably a stake pin 32 is utilized to prevent the stake pin 16 from working its way out of the mounting surface 102. A pair of openings 38 are formed through the sides of the roller frame 20 and the stake pin 32 is inserted therethrough. The stake pin 32 preferably includes a pin body 40, a tapered front end 42, at least one spring loaded ball 34 and a withdrawal ring 36 disposed on a rear end. Other methods and devices may also be used to prevent the stake 16 from withdrawing from the mounting surface 102. The stake pin 32 may be purchased as a standard product from a tool component manufacturer.

Figure 6:
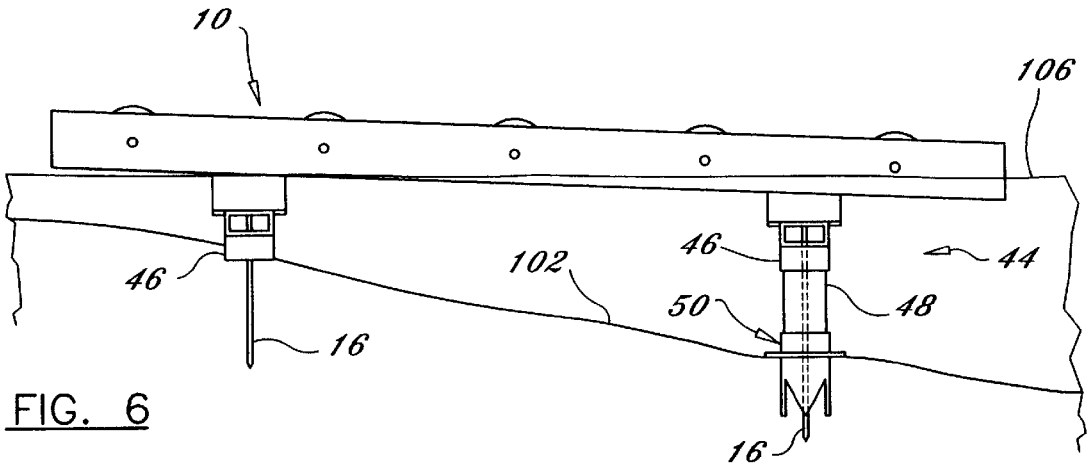
FIG. 6 is a side view of a boat landing apparatus with a pair of height spacers in accordance with the present invention.
Figure 9:
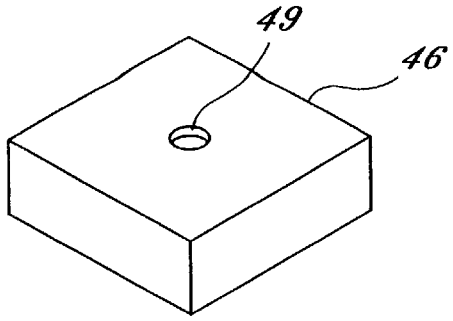
FIG. 9 is a cross sectional view of a post retainer of a boat landing apparatus in accordance with the present invention.
Figure 9:
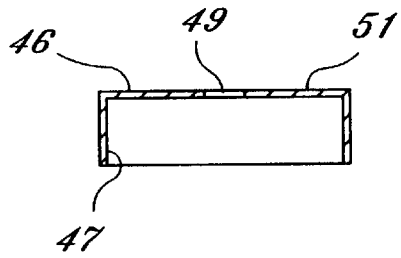
Figure 8:
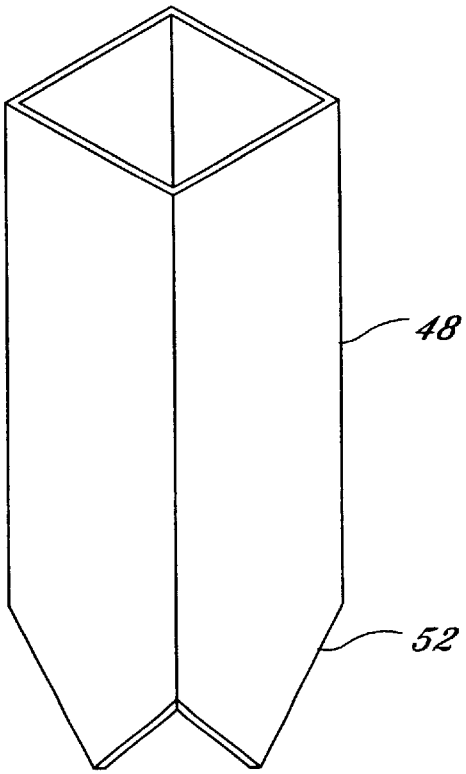
FIG. 8 is an exploded perspective view of a height spacer of a boat landing apparatus in accordance with the present invention.
Figure 8:
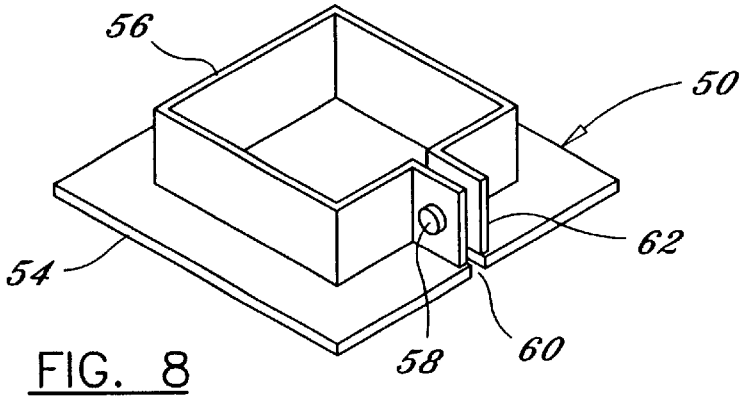

With reference to FIGS. 6, 8 and 9, a height spacer 44 may be used to adjust the height of one end of the boat landing device 1. The height spacer 44 preferably includes a tubular post 48 and a flange retainer 50. The post retainer 46 is preferably a tubular device with a top portion 51. The post retainer has an inner perimeter 47 which is sized slidably receive the tubular post 48. A stake clearance hole 49 is formed through the top portion 51 of the post retainer 46. A point 52 is preferably formed on a bottom of each side of the tubular post 48. The point 52 facilitates insertion of the tubular post 48 into a lake bottom. A square shaped tubular post 48 is shown, but other shapes may also be used.

Figure 7:
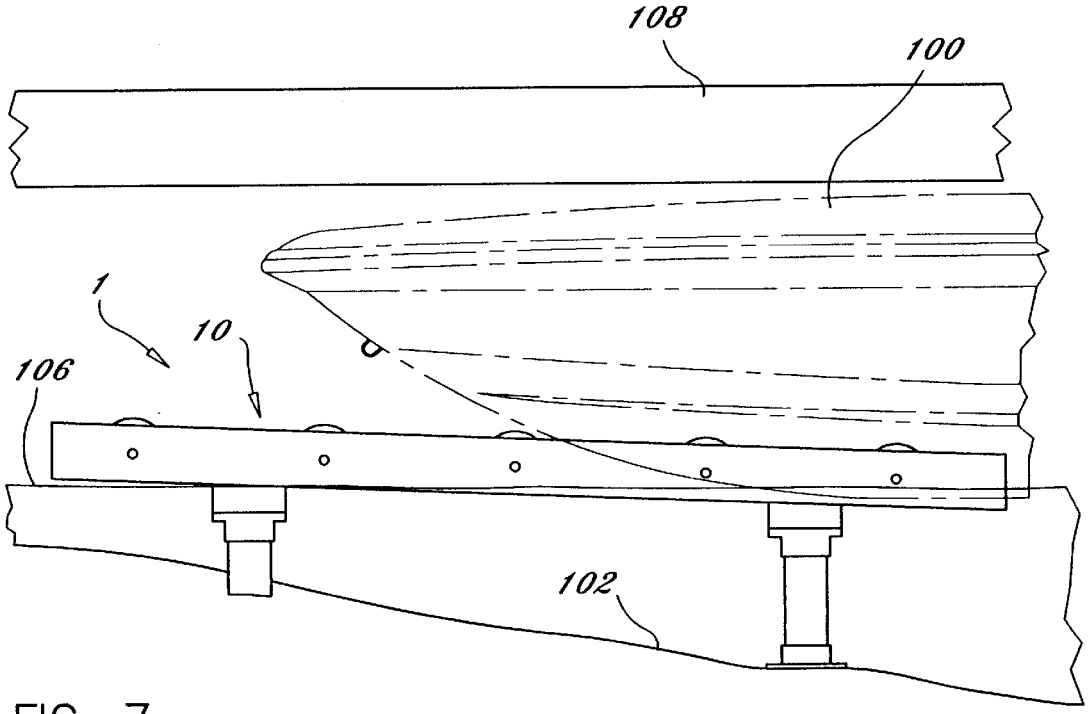
FIG. 7 is a side view of a boat landing apparatus with a boat partially landed thereupon adjacent a pier in accordance with the present invention.

A flange retainer 50 includes a flange plate 54, a clamp 56, and a fastener 58. The clamp 56 is preferably attached to a top of the flange plate 54 with any suitable assembly process such as welding. A slit 60 is formed in the flange plate 54 adjacent a tightening flange 62. The slit 60 allows the clamp to be tightened around the tubular post 48. The attachment of the flange retainer 50 to the tubular post 48 prevents the rear of the boat landing apparatus 1 from sinking into a lake bottom. The fastener 58 is used to tighten the clamp 50 against the tubular post 48. The post retainer 46, tubular post 48, and flange retainer 50 are preferably fabricated from any material which does not corrode in water. Other designs of height spacers may also be used. FIG. 7 shows a boat 100 pulled half way on to a boat landing apparatus 1 adjacent a pier 108.

Figure 10:
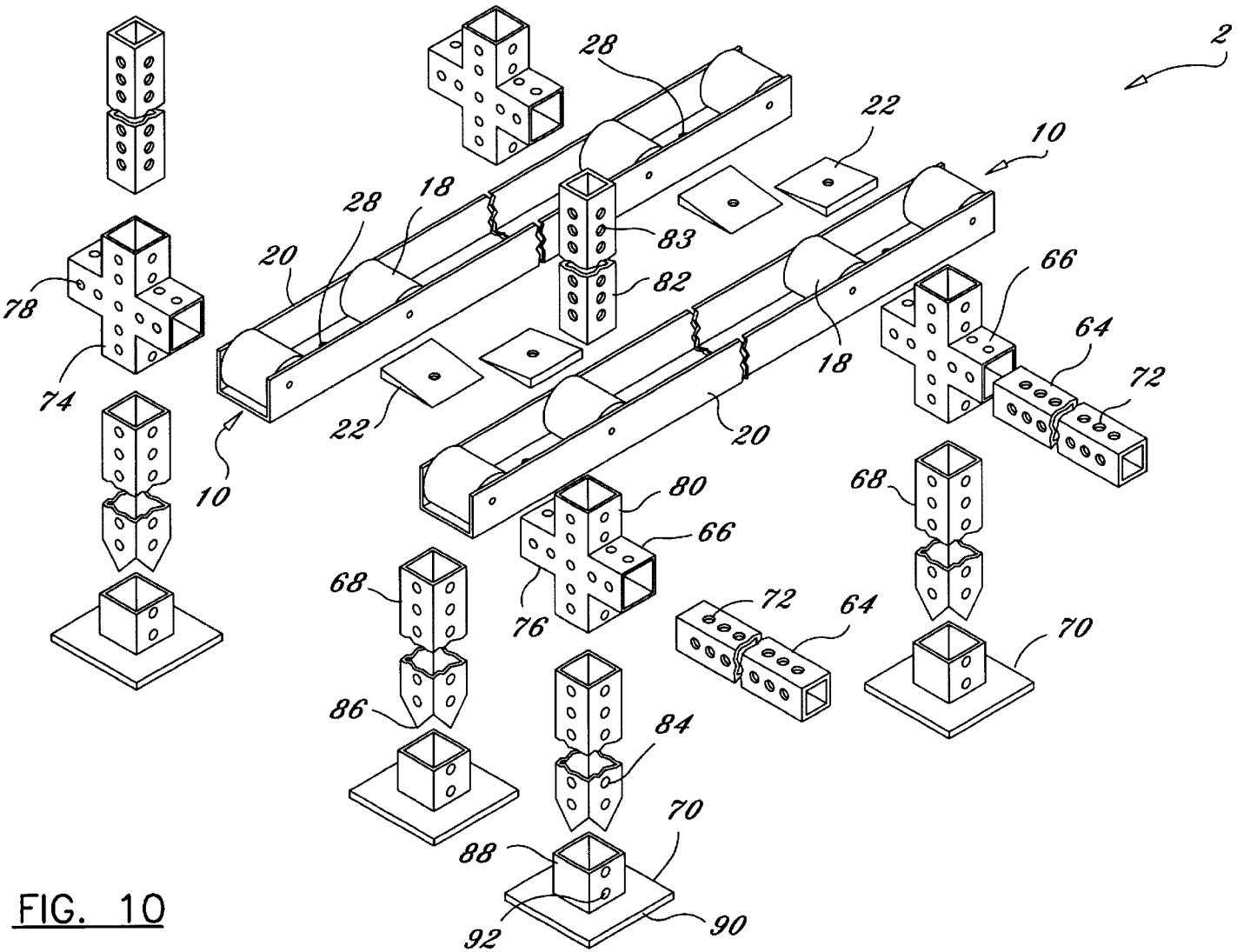
FIG. 10 is an exploded perspective view of a second embodiment of a boat landing apparatus in accordance with the present invention.

FIG. 10 shows a second embodiment of the boat landing apparatus 2. The boat landing apparatus 2 includes a pair of roller assemblies 10, at least two cross members 64, at least four support brackets 66, at least four support posts 68, and at least four support spacers 70. Two cross members 64 and four support posts 68 are preferable, but more could be used. Each roller assembly 10 includes a plurality of rollers 18 pivotally retained in a roller frame 20. Each cross member 64 is preferably a rectangular tube with a plurality of holes 72 formed through the sides thereof. Each support bracket 66 preferably has a support flange 74 mounted substantially perpendicular to a bottom of a cross tube 76. An inner perimeter of the support flange 74 receives a single support post 68. The inner perimeter of the cross tube 76 receives a single cross member 64. A guide flange 80 may be mounted to a top of the cross tube 76 to receive a guide post 82. A plurality holes 83 are preferably formed through the sides of the guide post 82. Each support bracket 66 includes a plurality holes 78 formed therethrough. The cross tube 76 is preferably fabricated from a first rectangular tube and the support flange 74 from a second rectangular tube. The guide flange 80 is preferably fabricated from a third rectangular tube.

Each support post 68 has a plurality of holes 84 formed through the sides thereof. Preferably, a bottom end of each support post 68 has at least one side sharpened to a point 86 to facilitate insertion into a bottom of a body of water. Other sharpening schemes may also be used besides that disclosed in FIGS. 10–13. A single support spacer 70 includes a support flange 88 and a support foot 90. At least one hole 92 is formed through the post flange 88. The support spacers 70 prevent the boat landing apparatus 2 from sinking into the bottom of the body of water. With reference to FIG. 13, the boat landing apparatus 2 is preferably mounted with a backward pitch. The backward pitch allows water 110 trapped in the back of the boat to drain out through a drain opening 112.

Figure 11:
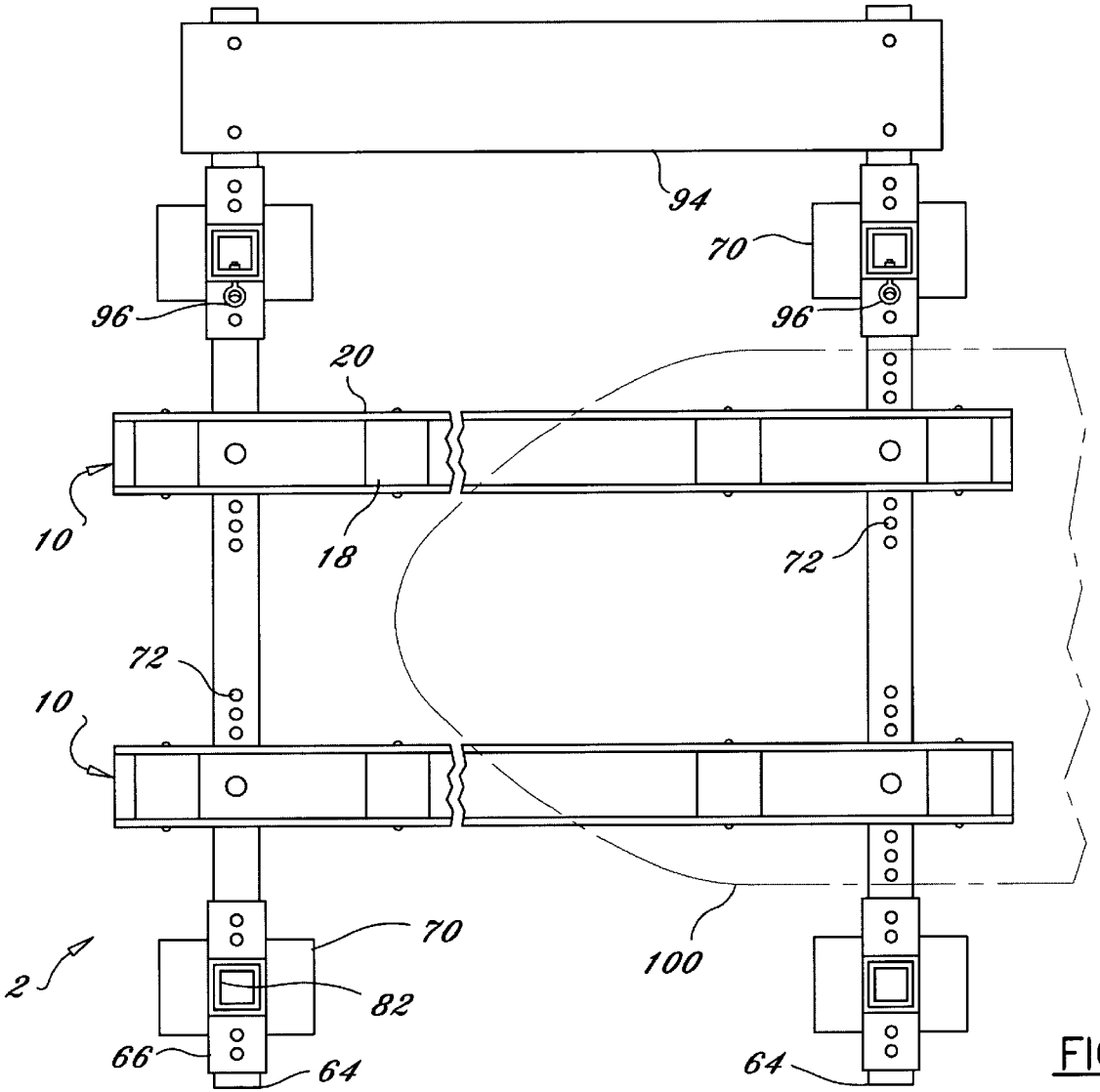
FIG. 11 is a top view of a second embodiment of a boat landing apparatus in accordance with the present invention.
Figure 12:
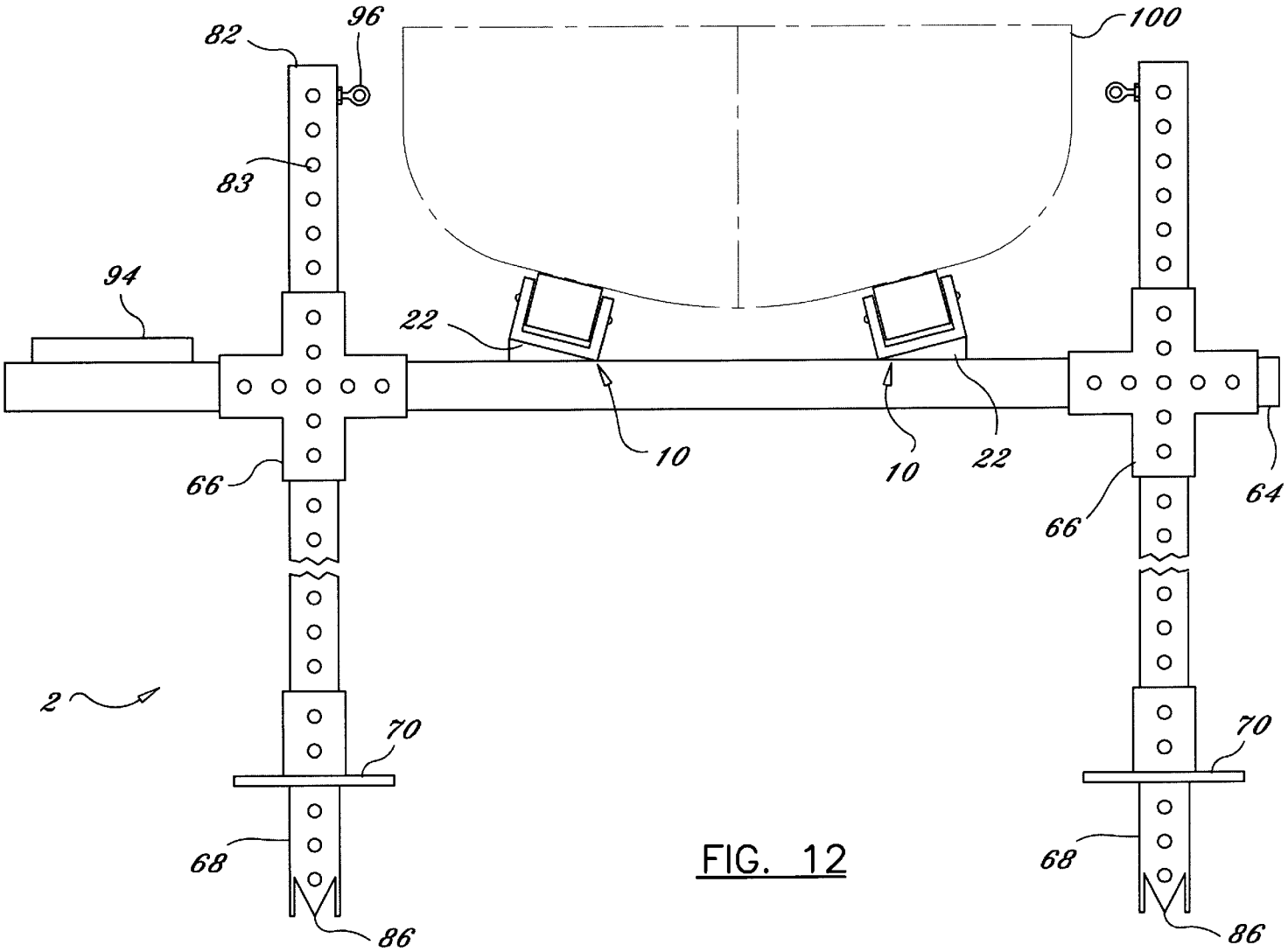
FIG. 12 is a front view of a second embodiment of a boat landing apparatus in accordance with the present invention.
Figure 13:
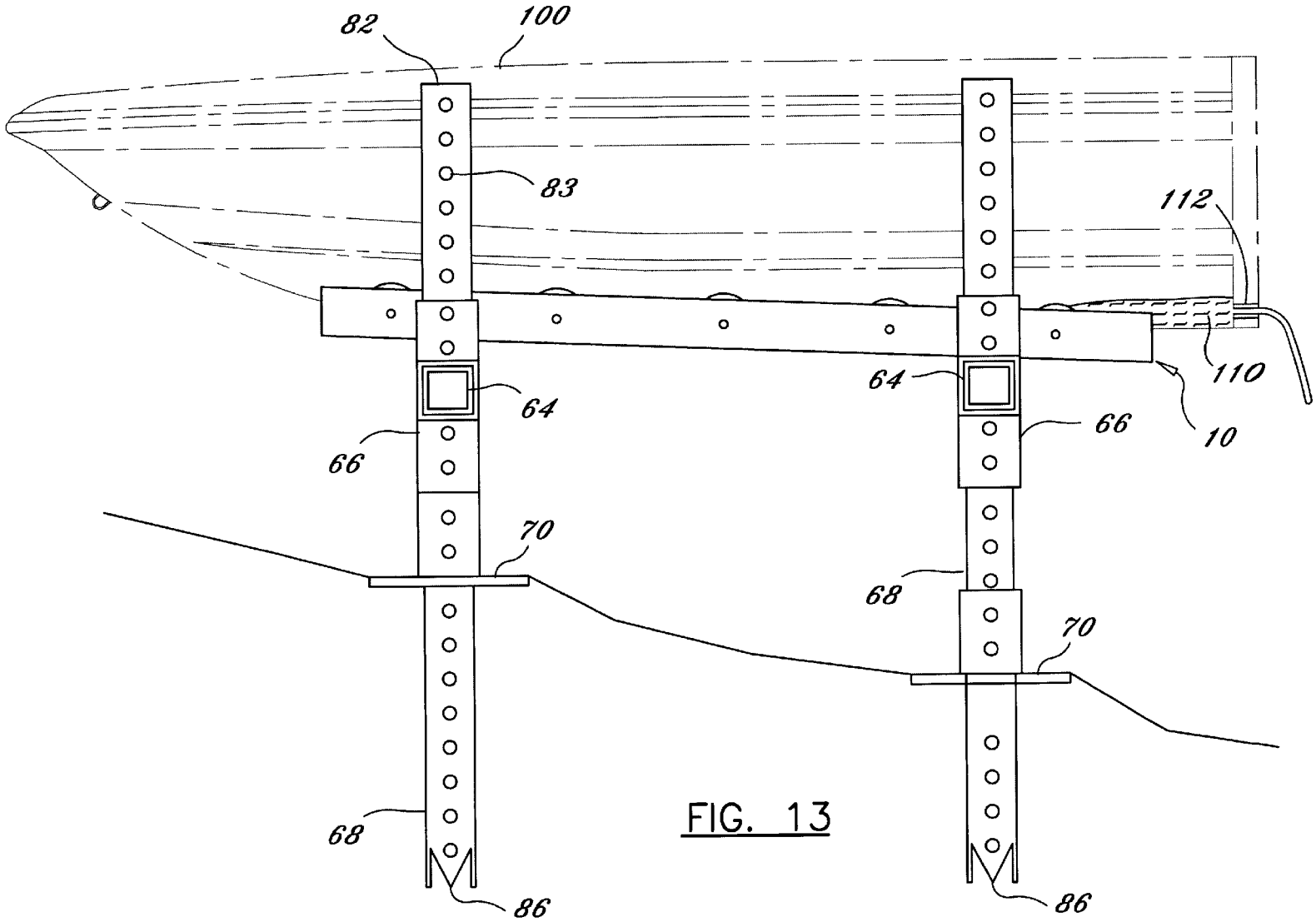
FIG. 13 is a side view of a second embodiment of a boat landing apparatus in accordance with the present invention.

With reference to FIGS. 11–13, one end of each roller assembly 10 is mounted to one of the cross members 64 with any suitable fastener and the other end of each roller assembly 10 is mounted to the other cross member 64 with any suitable fastener. The wedge spacers 22 are placed between a bottom of the roller frames 20 and a top of the cross members 64; the wedge spacers 22 enable the pair of roller assemblies 10 to have an inward tilt. A single support bracket 66 is secured to each end of each cross member 10 with any suitable fasteners. A single support post 68 is inserted into the post flange 74 of each support bracket 66 and secured thereto with any suitable fasteners. A post flange 88 of a single height spacer 70 is slid on to each support post 68 and attached thereto with any suitable fasteners. The cross member 64 may be made with a sufficient length such that an access plank 94 may be attached to one end of each cross member 64 with any suitable fasteners.

A guide post 82 may be inserted into the guide flange 80 of at least one support bracket 66. An eye bolt 96 or the like may be fastened in one of the holes 83 of the guide post 82. The boat 100 may be retained by attaching a line to the eye bolt 96. The boat landing apparatus 2 may be installed by first inserting the support posts 68 into a bottom of a body of water and successively assembling the remaining elements of the boat loading apparatus 2 on the installed support posts 68. The boat landing apparatus 2 may also be assembled and then inserted into a bottom of a body of water.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

We claim:

1. A boat landing apparatus comprising:

a pair of roller assemblies, each said roller assembly including a plurality of rollers pivotally attached to a roller frame, one opening being formed through said roller frame at substantially each end thereof;

at least two cross members, each said cross member having a plurality of cross member openings formed along a length thereof, said pair of roller assemblies being secured to said at least two cross members;

at least four support posts; and at least four support brackets, a single said support post being secured to said cross member with a single said support bracket.

2. The boat landing apparatus of claim 1, further comprising:

at least four support spacers being secured to said at least four support posts, each said support spacer including a post flange attached to a foot, at least one hole being formed through said post flange.

3. The boat landing apparatus of claim 1, further comprising:

a bottom end of each said support post being sharpened to at least one point to facilitate insertion into a bottom of a body of water, a plurality of holes being formed through said support post.

4. The boat landing apparatus of claim 1, further comprising:

a wedge spacer being inserted between a bottom of said roller frame and a top of a single said cross member, said wedge spacer causing said roller assembly to tilt inward to facilitate easy loading of a boat.

5. The boat landing apparatus of claim 1, further comprising:

each said support bracket including a support flange mounted substantially perpendicular to a bottom of a cross tube, a plurality holes being formed through said support flange and said cross tube.

6. The boat landing apparatus of claim 5, further comprising:

a guide flange being mounted to a top of said cross tube.

7. A boat landing apparatus comprising:

a pair of roller assemblies, each said roller assembly including a plurality of rollers pivotally attached to a roller frame, one opening being formed through said roller frame at substantially each end thereof;

at least two cross members, each said cross member having a plurality of cross member openings formed along a length thereof, said pair of roller assemblies being secured to said at least two cross members;

at least four support posts;

at least four support brackets, a single said support post being secured to said cross member with a single said support bracket; and at least four support spacers being secured to said at least four support posts.

8. The boat landing apparatus of claim 7, further comprising:

each said support spacer including a post flange attached to a foot, at least one hole being formed through said post flange.

9. The boat landing apparatus of claim 7, further comprising:

a bottom end of each said support post being sharpened to at least one point to facilitate insertion into a bottom of a body of water, a plurality of holes being formed through said support post.

10. The boat landing apparatus of claim 7, further comprising:

a wedge spacer being inserted between a bottom of said roller frame and a top of a single said cross member, said wedge spacer causing said roller assembly to tilt inward to facilitate easy loading of a boat.

11. The boat landing apparatus of claim 7, further comprising:

each said support bracket including a support flange mounted substantially perpendicular to a bottom of a cross tube, a plurality holes being formed through said support flange and said cross tube.

12. The boat landing apparatus of claim 11, further comprising:

a guide flange being mounted to a top of said cross tube.

13. A boat landing apparatus comprising:

a pair of roller assemblies, each said roller assembly including a plurality of rollers pivotally attached to a roller frame, one opening being formed through said roller frame at substantially each end thereof;

at least two cross members, each said cross member having a plurality of cross member openings formed along a length thereof, said pair of roller assemblies being secured to said at least two cross members;

at least four wedge spacers being inserted between a bottom of said pair of roller frames and a top of said at least two cross members;

at least four support posts;

at least four support brackets, a single said support post being secured to said cross member with a single said support bracket; and at least four support spacers being secured to said at least four support posts.

14. The boat landing apparatus of claim 13, further comprising:

each said support spacer including a post flange attached to a foot, at least one hole being formed through said post flange.

15. The boat landing apparatus of claim 13, further comprising:

a bottom end of each said support post being sharpened to at least one point to facilitate insertion into a bottom of a body of water, a plurality of holes being formed through said support post.

16. The boat landing apparatus of claim 13, further comprising:

each said support bracket including a support flange mounted substantially perpendicular to a bottom of a cross tube, a plurality holes being formed through said support flange and said cross tube.

17. The boat landing apparatus of claim 16, further comprising:

a guide flange being mounted to a top of said cross tube.

* * * * *